US006045861A

United States Patent [19]

Lindauer et al.

[11] Patent Number: 6,045,861

[45] Date of Patent: Apr. 4, 2000

[54] THREE-DIMENSIONAL EXPANDABLE SPONGE ARTICLE USEFUL FOR (I) DE-WRINKLING AND (II) AROMATIZING AND/OR FRESHENING CLOTHING AND/OR LINENS, USES THEREOF AND PROCESS FOR PREPARING SAME

[75] Inventors: Jerome I. Lindauer, Hillsdale; Elizabeth Falabella, Point Pleasant, both of N.J.; Nikki Rodriguez, Yonkers, N.Y.

[73] Assignee: International Flavors & Fragrances Inc., New York, N.Y.

[21] Appl. No.: 09/252,017

[22] Filed: Feb. 18, 1999

Related U.S. Application Data

[62] Division of application No. 09/084,091, May 26, 1998.

[51] Int. Cl.[7] ..... C11D 1/62

[52] U.S. Cl. ..... 427/242; 510/519; 510/520

[58] Field of Search ..... 510/516, 518, 510/517, 519, 520; 427/242

[56] References Cited

U.S. PATENT DOCUMENTS

| | | | |
|---|---|---|---|
| 4,076,633 | 2/1978 | Edwards et al. | 252/8.75 |
| 4,248,928 | 2/1981 | Spadini et al. | 428/286 |
| 4,824,582 | 4/1989 | Nayar | 510/517 |
| 5,234,610 | 8/1993 | Gardlik et al. | 510/327 |
| 5,238,587 | 8/1993 | Smith et al. | 252/8.6 |
| 5,552,378 | 9/1996 | Trinh et al. | 512/3 |

FOREIGN PATENT DOCUMENTS

| | | | |
|---|---|---|---|
| 9700993 | 1/1997 | WIPO | D06L 1/02 |

OTHER PUBLICATIONS

General Electric Automatic Dryer "Use and Care Book," Publication No. 49–9210, publication date of Jun. 1976, pp. 4,5,12,13, front cover and back cover, publisher: General Electric Company, Home Laundry Products Division, Appliance Park, Louisville, Kentucky 40225.

*Primary Examiner*—Yogendra Gupta
*Assistant Examiner*—John R. Hardee
*Attorney, Agent, or Firm*—Arthur L. Liberman

[57] ABSTRACT

Described is an expandable sponge article, initially substantially anhydrous useful for aromatizing and/or freshening and de-wrinkling clothes and linens (e.g., towels, sheets, pillowcases and the like) consisting of a relatively small expandable sponge having contained in the interstices thereof perfume oil and a fragrance substantivity/fabric relaxing substance. The article is specifically intended to be used on clothing and/or linens in need of de-wrinkling and aromatization and/or freshening, and such use is effected in an automatic dryer (which has different "cycles"); on operation of the "fluff" cycle. The sponge article of our invention is activated by placing water thereon and thereby hydrating and thus expanding the sponge article. The thus-hydrated and expanded sponge article is placed in an automatic dryer along with a suitable number of articles of clothing (e.g., 1–3) and/or linens in need of freshening and/or aromatization and de-wrinkling. The dryer is then run on the "fluff" cycle (ambient temperature operation) for 0.52–2 hours. The clothing articles and/or linens are then removed from the dryer and hung and/or stretched for a relatively short period of time at the end of which they are (i) wrinkle free and (ii) freshened and/or aromatized.

5 Claims, 4 Drawing Sheets

THREE-DIMENSIONAL EXPANDABLE SPONGE ARTICLE USEFUL FOR (I) DE-WRINKLING AND (II) AROMATIZING AND/OR FRESHENING CLOTHING AND/OR LINENS, USES THEREOF AND PROCESS FOR PREPARING SAME

This is a Divisional of application Ser. No. 09/084,091 filed on May 26, 1998.

BACKGROUND OF THE INVENTION

As a result of the high cost and environmental considerations of traditional dry cleaning, there have been recent introductions into the marketplace, worldwide, of products designed to "freshen" dry cleanable clothes at home either in a washing process or in the drying process. Thus, for example, Siklosi, et al, U.S. Pat. No. 5,547,476 issued on Aug. 20, 1996 discloses a home dry cleaning process whereby a carrier sheet releasably impregnated with solvents such as butoxy propoxy propanol, 1,2-octanediol as a wetting agent, water and an emulsifier is placed in a plastic bag with soiled garments and tumbled in a hot air clothes dryer. Using the Siklosi, et al "dry cleaning process," the garments are cleaned and refreshed. Davis, et al in U.S. Pat. No. 5,681,355 issued on Oct. 28, 1997 discloses a dry cleaning process conducted in a hot air clothes dryer using a containment bag. In U.S. Pat. No. 5,681,355, the bag is constructed using heat resistant polymers such as nylon to avoid unanticipated hot spots in the dryer; and the bag retains its integrity and can be reused in subsequent dry cleaning operations.

A need has arisen for processes which give rise to de-wrinkling as well as freshening and/or aromatization wherein no heat is required, the fragrance performance is improved, and in general, the process is relatively easy to use at home.

The use of sponges in conjunction with clothing treatment processes is known in the prior art. Thus, in U.S. Pat. No. 4,824,582 issued on Apr. 25, 1989, dryer-added fabric conditioning articles such as sponges are disclosed utilizing alkyl amine-anionic surfactant ion-pair complexes as fabric conditioning agents. It is indicated in U.S. Pat. No. 4,824,582 that the compositions thereof can contain polymeric soil release agents and fabric softeners. In the method of U.S. Pat. No. 4,824,582, damp fabrics are commingled with the conditioner active and other optional components, e.g., fragrances, in automatic laundry dryer and are provided with a soft, antistatic finish concurrently with the drying operation. It is further indicated in U.S. Pat. No. 4,824,582 that the fabric conditioning agents are preferably employed in combination with a dispensing means adapted for use in an automatic dryer. At column 11, lines 1–9 of U.S. Pat. No. 4,824,582, it is indicated:

> "One such article comprises a sponge or porous material releasably enclosing enough fabric conditioning composition to effectively impart fabric care benefits during several cycles of clothes. Such a substrate will have a weight ratio of fabric conditioning agent to dry substrate on a dry weight basis ranging from about 10:1 to about 0.25:1. This multi-use article can be made by filling, for example, a hollow sponge with about 20 grams of the fabric conditioning composition."

At column 18, line 67, it is indicated that 1.3 weight percent of "perfume" can be included in a dryer-added sheet substrate composition."

The problem of freshening clothing using fragrances in conjunction with clothes dryers is well known in the prior art. Thus, U.S. Pat. No. 5,094,761 issued on Mar. 10, 1992; U.S. Pat. No. 5,102,564 issued on Apr. 7, 1992; and U.S. Pat. No. 5,234,610 issued on Aug. 10, 1993 disclose the use of an effective amount of perfume/cyclodextrin complex in application to a fabric that is preferably at least partially wetted. In one method disclosed, a perfume/cyclodextrin complex is applied to a fabric in an automatic laundry dryer. It is further disclosed in these patents that the perfume/cyclodextrin complexes are preferably incorporated into solid, dryer-activated fabric treatment (conditioning) compositions preferably containing fabric softeners, more preferably cationic and/or nonionic fabric softeners. It is further indicated that volatile perfume materials including those materials that are commonly associated with "freshness" can be applied to the fabrics in "an effective way" and that clay provides protection for the perfume/cyclodextrin complexes.

A need exists for providing results such as those obtained in U.S. Pat. No. 5,094,761, U.S. Pat. No. 5,104,564 and U.S. Pat. No. 5,234,610 wherein perfumes which are not complexed can be delivered to dry cleanable garments without the use of heat and without the perfumes being complexed with such materials as cyclodextrins and at the same time rendering the resulting garments wrinkle free.

Our invention has, in an unexpected, unobvious, advantageous manner, fulfilled the needs as set forth, supra, in the fabric de-wrinkling/aromatization and/or freshening area.

SUMMARY OF THE INVENTION

Our invention provides a three-dimensional expandable sponge article useful for (i) de-wrinkling and, simultaneously, (ii) aromatizing and/or freshening clothing and/or linens as a result of the use thereof in automatic clothes dryers on the "fluff" (ambient temperature and pressure) cycle of the dryer.

More specifically, our invention is directed to a substantially anhydrous, three-dimensional expandable sponge article located in a three-dimensional space, having a vertical z axis and horizontal x and y axes consisting essentially of:

(i) a substantially anhydrous hydrophilic expandable sponge substance having a volumetric expandability factor of from about 1.3 up to about 4.0, having a discrete geometric shape, a thickness along the z axis in the range of from about 0.05 inches up to about 2.0 inches, an average dimension along the x axis of from about 1 inch up to about 6 inches, an average dimension along the y axis of from about 1 inch up to about 6 inches, a surface area of from about 3 square inches up to about 150 square inches and having sufficient porosity to retain from about 0.25 up to about 2.0 grams of perfume oil; and (ii) contained within the interstices of said sponge substance and absorbed therein from about 0.25 up to about 2.0 grams of a substantially anhydrous perfume oil intimately admixed with from about 0.25 up to about 2.0 grams of at least one substantially anhydrous fragrance substantivity-fabric relaxing agent selected from the group consisting of dialkyl dimethyl quaternary ammonium salts, imidazolinium quaternary salts, diamidoamine quaternary salts and monomethyl trialkyl quaternary ammonium salts.

More preferably, the perfume oil set forth above is hydrophobic.

More specifically, the fragrance substantivity/fabric relaxing agent is selected from the group of compounds defined according to the structures:

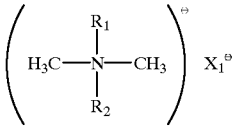

wherein $R_1$ and $R_2$ are the same or different $C_8$–$C_{22}$ straight chain or branched chain alkyl or alkenyl; and wherein $X_1$ is chloro or methyl sulfate;

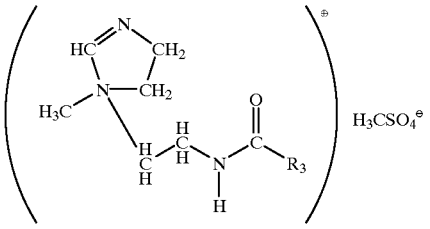

wherein $R_3$ is $C_{12}$–$C_{18}$ straight chain alkyl or alkenyl;

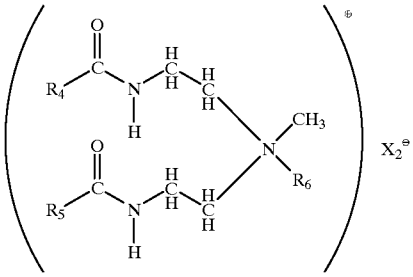

wherein $R_4$ and $R_5$ are the same or different $C_{12}$–$C_{18}$ straight chain alkyl or alkenyl; $R_6$ is 2-hydroxyethyl or 2-hydroxypropyl; and $X_2$ is methyl sulfate or chloro; and

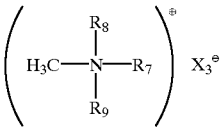

wherein $R_7$, $R_8$ and $R_9$ are the same or different $C_8$–$C_{18}$ straight chain or branched chain alkyl; and $X_3$ is chloro, bromo, iodo or methyl sulfate.

The sponges useful in the practice of our invention are compressed sponges well known to those having ordinary skill in the art. Examples of the sponge materials useful in the practice of our invention are:

I. Natural Sponge Substances:

| Name No. | Name |
|---|---|
| 10 | Hippiospongia |
| 11 | Spongia |
| 12 | Wiscossin spongillinae |
| 13 | *Euspongilla lacutris* |
| 14 | *Meyenia mülleri* |
| 15 | *Suberites domuncula* |
| 16 | *Ficulina ficus* |
| 17 | *Spongilla lacustris* |

-continued

I. Natural Sponge Substances:

| Name No. | Name |
|---|---|
| 18 | *Cliona celata* |
| 19 | *Spheciospongia vesparia* |
| 20 | *Halichondria panicea* |
| 21 | *Stylotella heliophila* |
| 22 | *Microciona prolifera* |
| 23 | *Chalina arbuscula* |
| 24 | *Tetilla laminaris* |
| 25 | Haliclona |
| 26 | *Kirkpatrickia variolosa* |
| 27 | *Latrunculia apicalis* |
| 28 | *Dendrilla membranosa* |
| 29 | *Isodictya crinacea* |

II. Synthetic Sponges:

(i) artificial sponges made from cellulose derivatives such as viscose, subjected to a pressure of 100 lbs per square inch and to a temperature of about 90° C., whereby the treatment reduces considerably the thickness of the sponges without increasing their surface dimensions as disclosed in United Kingdom Patent Specification No. 539,785 of Sep. 24, 1941, assigned to Sponcel Ltd. and Cyril V. Barker and abstracted in *Chemical Abstracts,* 1942 at 4337(6);

(ii) Chlorovinyl resin sponges produced according to the process disclosed in Belgian Patent Specification No. 448, 061 of Dec. 31, 1942 (Pirelli Società per Azioni), abstracted at *Chemical Abstracts,* 1945, column 1571(7) (Volume 39);

(iii) Cellulosic sponges (cellulose acetate, propionate, butyrate and mixed esters) produced according to Haney and Martin, U.S. Pat. No. 2,372,669 of Apr. 3, 1945, the specification for which is incorporated by reference herein (abstracted at *Chemical Abstracts,* Volume 39, column 3668 (1–5);

(iv) Artificial sponges formed from organic esters of cellulose and/or polymerized vinyl acetate produced according to the process of Taylor and Gibbins as disclosed in U.S. Pat. No. 2,223,538 of Dec. 3, 1939, the specification for which is incorporated by reference herein;

(v) Reinforced natural and artifical sponges which are impregnated substantially throughout with a dispersion of rubber as disclosed by Kraft in U.S. Pat. No. 2,257,911 of Oct. 7, 1942, the specification for which is incorporated by reference herein (abstracted at Chemical Abstracts, 1942, column 597(4);

(vi) Sponges produced as a result of the reaction of cellulose with a carboxymethylating agent, whereby a "lightly" carboxymethylated cellulose is formed as disclosed by Courtaulds PLC in PCT Published Patent Application No. 95/15342 published on Jun. 8, 1995, the specification for which is incorporated by reference herein; and (vii) Cellulose sponges produced by admixing a cellulose solution in an aqueous tertiary amine oxide with a pore former and a foaming agent and then subjecting it to conditions resulting in a decomposition of the foaming agent and the foaming of the cellulose solution whereafter the foamed cellulose solution is brought into contact with water to precipitate the cellulose as disclosed in the specification of PCT Published Patent Application No. 97/23552 published on Jul. 3, 1997, the specification for which is incorporated by reference herein (assigned to Lenzing Aktiengesellschaft).

Our invention is also directed to processes for de-wrinkling and freshening and/or aromatizing clothing or linens comprising the steps of:

(i) adding water to the sponge article described, supra, in a weight ratio of water:sponge article of from about 1:5 up to about 5:1 in order to form a hydrated article;

(ii) providing an automatic clothes and linen dryer having a "fluff" cycle which operates at from about 20° C. up to about 30° C. at atmospheric pressure;

(iii) placing the clothing and/or linens into said automatic clothes and linen dryer;

(iv) placing said hydrated sponge article into said automatic clothes and linen dryer;

(v) setting the dryer to operate for a designated time period $\Delta\theta$ solely on the "fluff" cycle;

(vi) operating said dryer for the time set for the "fluff" cycle; and (vii) removing the clothing and/or linens from the dryer.

The thus "relaxed" and freshened and/or aromatized clothing or linens may then be hung or stretched. The resulting clothing and/or linens will thus be freshened and/or aromatized and wrinkle free.

The time set for the "fluff" cycle may be defined according to the algorithm:

$$-K_3 \ln_e\left[\frac{K_1 W_2 + K_2}{K_1 W_1 + K_2}\right] = \Delta\theta$$

or the algorithm:

$$\ln_e\left[\frac{K_1 W_1 + K_2}{K_1 W_2 + K_2}\right] = \frac{\Delta\theta}{K_3}$$

where $K_1$, $K_2$ and $K_3$ are constants depending on the surface area of the clothes and/or linens, the sponge article surface area and the ratio of the void space within the sponge article to the surface area of the sponge article; wherein $W_1$ is the initial water weight in the sponge article as well as the clothing and/or linens to be treated (in the event that the clothing and/or linens are "wet"); and $W_2$ is the final moisture content of the sponges as well as the clothing and/or linens treated. In most instances and from a practical standpoint, $W_2$ is a very small number compared with $W_1$, to wit: $W_1 >>> W_2$. Accordingly, the algorithm for the timing of the "fluff" cycle is as follows:

$$\Delta W = \left[\frac{K_2}{K_1}\right] e^{\left(\frac{\Delta\theta}{K_3}\right)}$$

wherein $W_2 <<< \Delta W$. Preferably, $K_1$, $K_2$ and $K_3$ are quantified as follows:

$$2 \leq \frac{K_2}{K_1} \leq 5$$

and $4 \leqq K_3 \leqq 6$.

In the foregoing algorithms, $W_1$, $W_2$ and $\Delta W$ are measured in units of grams and $\Delta\theta$ is measured in units of minutes.

Our invention also concerns a process for forming the substantially anhydrous, three-dimensional, expandable sponge article which, prior to addition of water, is substantially anhydrous. Such process comprises the sequential steps of:

(i) providing a water-free, quaternary ammonium salt-free and fragrance-free compressed and expandable substantially anhydrous sponge article, shown to be produced in the prior art as set forth, supra;

(ii) intimately admixing an anhydrous lower alkanol (e.g., ethyl alcohol, isopropyl alcohol and the like) with at least one substantially anhydrous fragrance substantivity-fabric relaxing agent which is, in the alternative, a dialkyl dimethyl quaternary ammonium salt, an imidazolinium quaternary salt, a diamidoamine quaternary salt or a monomethyl trialkyl quaternary ammonium salt to form a quaternary salt-lower alkanol mixture;

(iii) intimately admixing the resulting quaternary salt-lower alkanol mixture with a hydrophobic fragrance in order to form a quaternary salt-lower alkanol-hydrophobic fragrance mixture;

(iv) immersing said substantially anhydrous sponge article in a quaternary salt-lower alkanol-hydrophobic fragrance mixture, whereby from about 0.2 up to about 5 grams of fragrance is absorbed into the interstices of said substantially anhydrous sponge article; and (v) physically separating said lower alkanol from said substantially anhydrous sponge article by means of performing the unit operation of evaporation on said substantially anhydrous sponge article.

In the alternative, the quaternary salt-lower alkanol-hydrophobic mixture, into which the substantially anhydrous sponge article is immersed, can be formed by admixing all three components simultaneously instead of first admixing the quaternary salt and lower alkanol. Thus, the quaternary salt, lower alkanol and hydrophobic fragrance are admixed simultaneously to form the quaternary salt-lower alkanol-hydrophobic mixture; and then into this mixture, the anhydrous sponge article is immersed.

As stated, supra, the anhydrous, hydrophilic expandable sponge material has a volumetric expandability factor of from about 1.3 up to about 4.0. Thus, the volume of the sponge article, which is previously compressed, will expand from about 1.3 up to about 4 times its original volume when the water is added thereto. Prior art examples of use of such expandable sponge materials are set forth in the following U.S. patents:

(i) U.S. Pat. No. 5,316,689 issued on May 31, 1994 (Classification: Class 252, Subclass 92), title: "TOY SOAP CONTAINING COMPRESSED SPONGE WHICH POPS OUT DURING USE"; and (ii) U.S. Pat. No. 4,881,915 issued on Nov. 21, 1989 (title: "DINOSAUR EGG"), each of which patent is incorporated by reference herein.

The geometric shape of the sponge article may be cylindrical, ellipsoidal, rectangular-parallelepiped, elliptical-cylindrical or spherical.

BRIEF DESCRIPTION OF THE DRAWINGS

FIG. 1A sets forth the anhydrous, cylindrical, expandable sponge, and FIG. 1B sets forth the sponge after hydration, in expanded form.

FIGS. 2A and 2B show the sponge article of our invention in an ellipsoidal shape. FIG. 2A sets forth the anhydrous, ellipsoidal, expandable sponge article of our invention, and FIG. 2B sets forth the hydrated, ellipsoidal sponge article.

DETAILED DESCRIPTION OF THE DRAWINGS

Figure 1A:
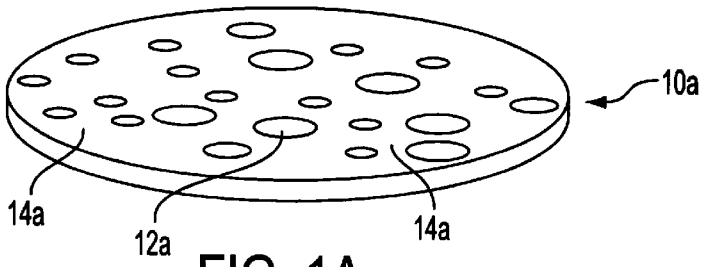
FIGS. 1A and 1B set forth an embodiment of the sponge article of our invention.
Figure 1B:
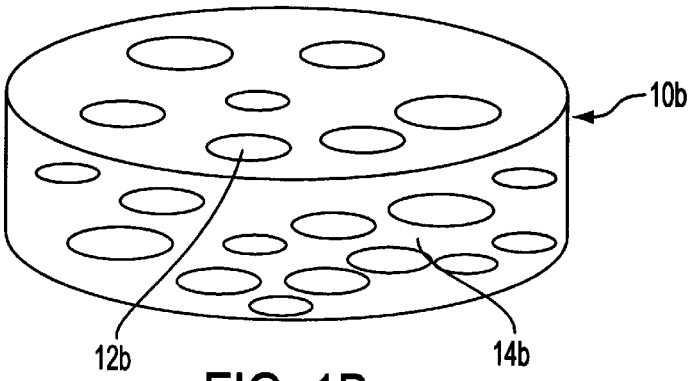

Referring to FIGS. 1A and 1B, reference numeral 10*a* sets forth the overall substantially anhydrous, three-dimensional, expandable sponge article in a cylindrical shape; and reference numeral 10*b* sets forth the same sponge article hydrated. Reference numerals 12*a* and 12*b* show the void spaces within the sponge article. Reference numerals 14*a* and 14*b* set forth solid portions of the sponge articles.

Figure 2A:
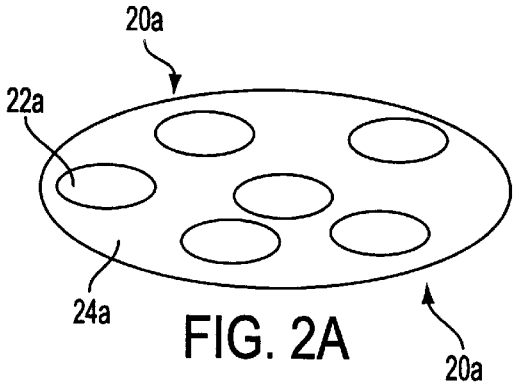
FIGS. 2A and 2B is another embodiment of the sponge article of our invention.
Figure 2B:
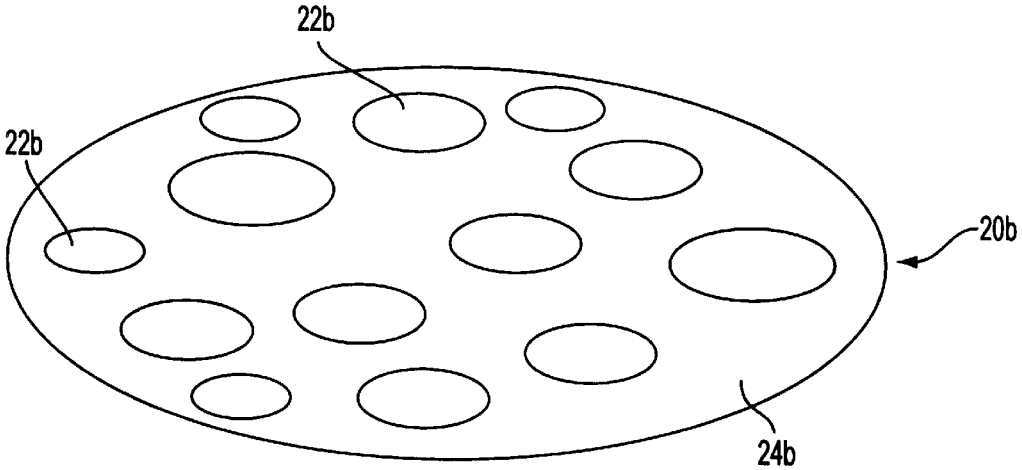

Referring to FIGS. 2A and 2B, both Figures show ellipsoidal, three-dimensional, expandable sponge articles of our invention, with FIG. 2A (indicated by reference numeral 20*a*) showing the anhydrous, three-dimensional, expandable, ellipsoidal sponge; and reference numeral 20*b* shows the same sponge hydrated. Reference numerals 22*a* and 22*b* show the void spaces in the expandable and hydrated sponges, respectively. Reference numerals 24*a* and 24*b* show the solid portions of the expandable and hydrated ellipsoidal sponges, respectively.

Figure 3:
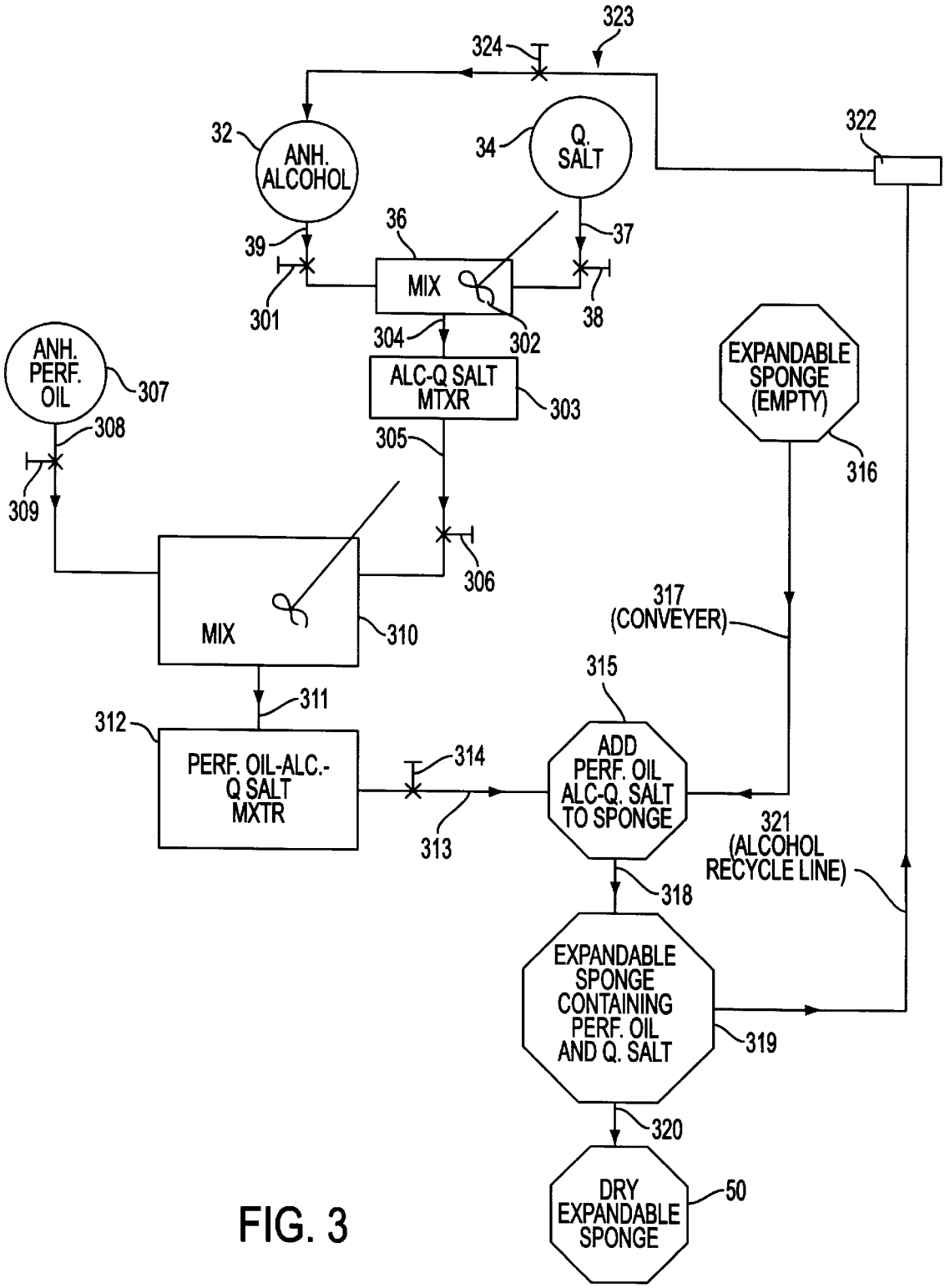
FIG. 3 sets forth the process of our invention for forming the substantially anhydrous, three-dimensional, expandable sponge article of our invention.

Referring to FIG. 3, anhydrous alcohol from location 32 (e.g., anhydrous isopropyl alcohol, anhydrous ethyl alcohol, anhydrous n-propyl alcohol or mixtures of same) flows through line 39 past control valve 301 into mixing vessel 36. Simultaneously, anhydrous quaternary salt from location 34 is passed through line 37 past control valve 38 into mixing vessel 36 wherein the quaternary salt and anhydrous alcohol are mixed using mixer 302. The anhydrous alcohol-quaternary salt mixture is then passed through line 304 into mixing vessel 303 from whence it is fed into mixing vessel 310 at a controlled rate through line 305 past control valve 306. Simultaneously, anhydrous perfume oil from location 307 is passed through line 308 past control valve 309 into mixing vessel 310 where the anhydrous perfume oil is admixed with the alcohol-quaternary salt mixture. The resulting perfume oil-anhydrous alcohol-quaternary salt mixture is then passed through line 311 into holding vessel 312. The resulting perfume oil-anhydrous alcohol-quaternary salt mixture is then passed through line 313 past control valve 314 to be added to the expandable sponge(s) which are originally stored in line 316 and then sent via conveyor 317 into location 315 wherein the perfume oil-alcohol-quaternary salt mixture is added to the sponge(s) at location 315. The resulting perfumed sponges are then transported via conveyor 318 to location 319 ("drying" location) where the anhydrous alcohol is evaporated. The anhydrous alcohol vapors are thus passed through line 321 to condenser 322. The resulting condensed anhydrous alochols are then recycled via line 323 past valve 324 back into the anhydrous alcohol supply vessel 32. The alcohol-free perfume oil-quaternary salt-containing expandable sponges are then stored at location 50 for use in processes such as that described in the detailed description of FIG. 5, infra, and used in Example I set forth, infra.

The expandable sponges supplied from location 316 may be produced by means of the process of PCT Application No. 97/23552 (published Jul. 3, 1997 and assigned to Lenzing Aktiengesellschaft of Lenzing, Austria) which discloses the process of mixing a cellulose solution in an aqueous, tertiary amine oxide with a pore former and a foaming agent and then subjecting it to conditions resulting in a decomposition of the foaming agent and the foaming of the cellulose solution whereafter the foam cellulose solution is brought into contact with water to precipitate the cellulose. A small amount (e.g., 0.1%) of hydroxymethyl methacrylate, hydrophilic binding agent prepolymer together with 0.0001% benzoyl peroxide catalyst is then added to the sponge material during formation while simultaneously compressing the cellulose sponge at a pressure of between 500 and 2,500 psig, preferably at about 1,000 psig. The resulting compressed sponge is then dried under a vacuum of between 0.1 and 1 mm/Hg pressure at a temperature of between about 35° C. and about 45° C. An example of such a material is distributed by the Vernon Sales Promotion Company of 29 Richwood Lane, Hauppauge, N.Y. 11788 (U.S.A.) (cylindrical 5-inch×0.125 inches compressed sponge SP5C, for example).

Examples of the quaternary salts useful in the process of our invention as follows:

TABLE I

| Name of Quaternary Salt (Produced by Sherex Chemical Company, Inc. of Dublin, Ohio 43017) | |
|---|---|
| Commercial Name of Material | Generic Name |
| ADOGEN ® 442 | Dihydrogenated tallow dimethyl ammonium chloride |
| ADOGEN ® 470 (75%) | Ditallow dimethyl ammonium chloride |
| AROSURF ® TA-100 | Distearyl dimethyl ammonium chloride |
| AROSURF ® TA-101 | Distearyl dimethyl ammonium chloride, modified |
| VARISOFT ® 136-100P | Proprietary blend |
| VARISOFT ® DS-100 | Proprietary blend |
| VARISOFT ® 137 | Dihydrogenated tallow dimethyl ammonium methyl sulfate |
| ADOGEN ® 442 E-83 | Dihydrogenated tallow dimethyl ammonium methyl sulfate |
| VARIQUAT ® K-300 | Dicoco dimethyl ammonium chloride |
| VARISOFT ® 445 | Methyl-1-hydrogenated tallow amidomethyl 2-hydrogenated tallow imidazolinium methyl sulfate |
| VARISOFT ® 3690 (75%) | Methyl-1 oleyl amidoethyl 2-oleyl-imidazolinium methyl sulfate |
| VARISOFT ® 3690N (90%) | Methyl-1 oleyl amidoethyl 2-oleyl-imidazolinium methyl sulfate |
| VARISOFT ® 222 (90%) | Methyl bis (tallow amidoethyl) 2-hydroxyethyl ammonium methyl sulfate |
| VARISOFT ® 222 (75%) | Methyl bis (tallow amidoethyl) 2-hydroxyethyl amonium methyl sulfate, modified |
| VARISOFT ® 222 LM (90%) | Methyl bis (tallow amidoethyl) 2-hydroxyethyl amonium methyl sulfate, modified |
| VARISOFT ® 222HV (90%) | Methyl bis (tallow amidoethyl) 2-hydroxyethyl amonium methyl sulfate, modified |
| VARISOFT ® 222 LT (90%) | Methyl bis (oleyl amidoethyl) 2-hydroxyethyl amonium methyl sulfate |
| VARISOFT ® 110 | Methyl bis (hydrogenated tallow amidoethyl) 2-hydroxyethyl ammonium methyl sulfate |
| VARISOFT ® 110 DEG | Methyl bis (hydrogenated tallow amidoethyl) 2-hydroxyethyl amonium methyl sulfate, modified |
| VARISOFT ® 222 PG (90%) | Methyl bis (tallow amidoethyl) 2-hydroxyethyl amonium methyl sulfate, modified |
| VARISOFT ® 910 | Methyl bis (2-hydroxyethyl) coco ammonium chloride |
| VARISOFT ® 920 | Methyl bis (2-hydroxyethyl) tallow ammonium chloride |

Figure 4:
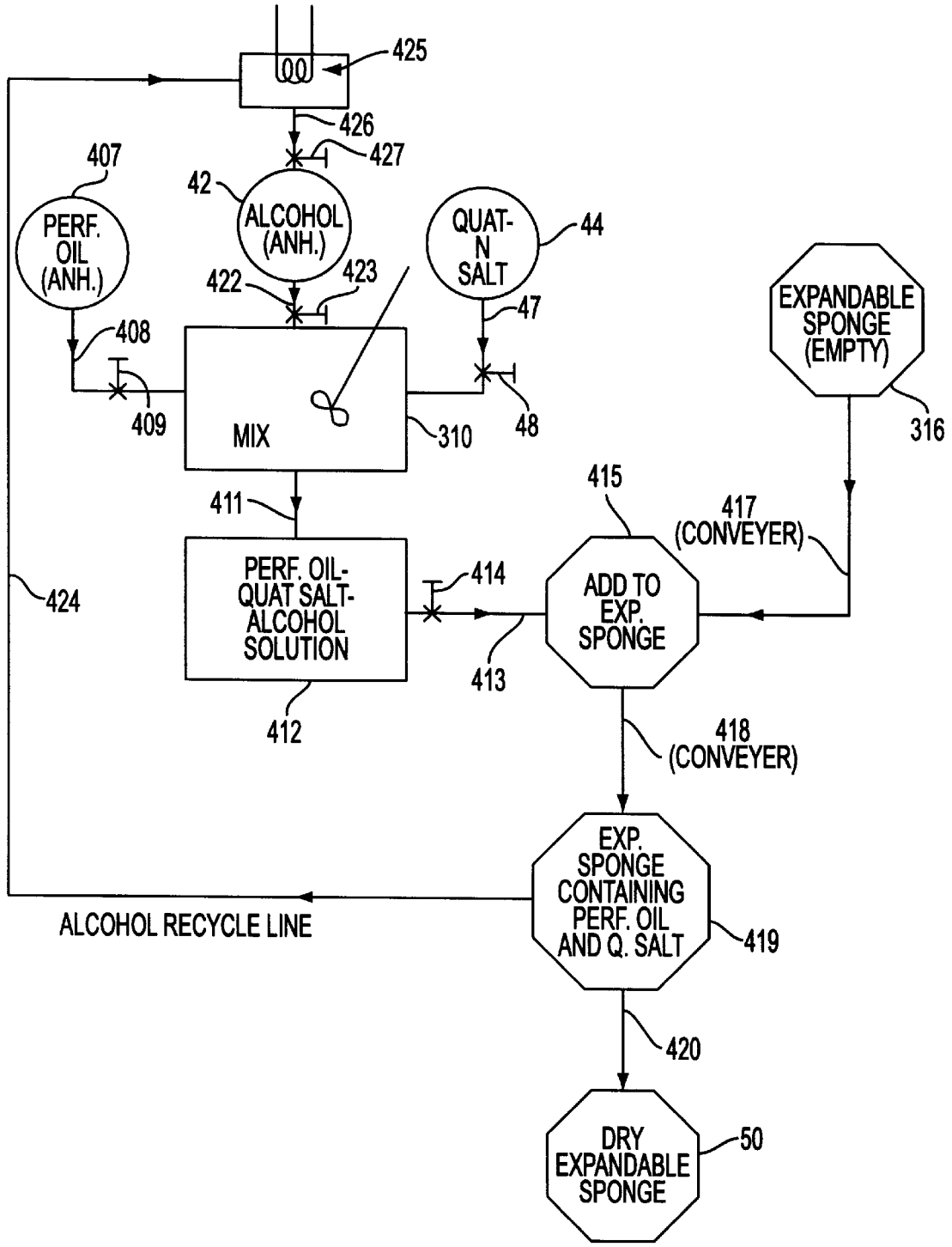
FIG. 4 sets forth a schematic block flow diagram of another embodiment of the process of our invention for forming the substantially anhydrous, three-dimensional, expandable sponge article of our invention.

Referring to FIG. 4, FIG. 4 is an alternate process for producing the substantially anhydrous, three-dimensional, expandable sponge article of our invention. Anhydrous perfume oil from vessel 407 is passed through line 408 past control valve 409 into mixing vessel 410. Simultaneously, anhydrous lower alkanol, e.g., anhydrous ethyl alcohol, anhydrous isopropyl alcohol, anhydrous n-propyl alcohol or mixtures of same from vessel 42 is passed through line 422 past valve 423 into mixing vessel 410. Simultaneously, from location 44, anhydrous quaternary salt is passed through line 47 past control valve 48 into mixing vessel 410, wherein all three anhydrous components are mixed under anhydrous conditions. The resulting perfume oil-lower alkanol-quaternary salt mixture is passed through line 411 into storage vessel 412 from whence it is passed through line 413 past control valve 414 to location 415 where the resulting mixture is added to empty expandable sponge which has been conveyed via conveyor 417 from location 316. The resulting sponge having the perfume oil-quaternary salt-lower alkanol solution added thereto is then conveyed via conveyor 418 to the evaporator 419 where the lower alkanol is evaporated from the sponge(s) to yield sponges containing solely perfume oil and quaternary salt, which sponges remain compressed. The thus-formed alcohol-free, perfume oil-quaternary salt-containing sponges are then transported via conveyor 420 to location 50 from whence they are used, for example, in the process set forth in Example I and described in detail in the detailed description of FIG. 5.

The evaporated lower alkanol (or mixture of same) in the vapor phase is passed through line 424 to condenser 425 where the lower alkanol or mixture thereof is condensed and the condensate is passed through line 426 past valve 427 back into anhydrous lower alkanol-containing vessel 42.

Figure 5:
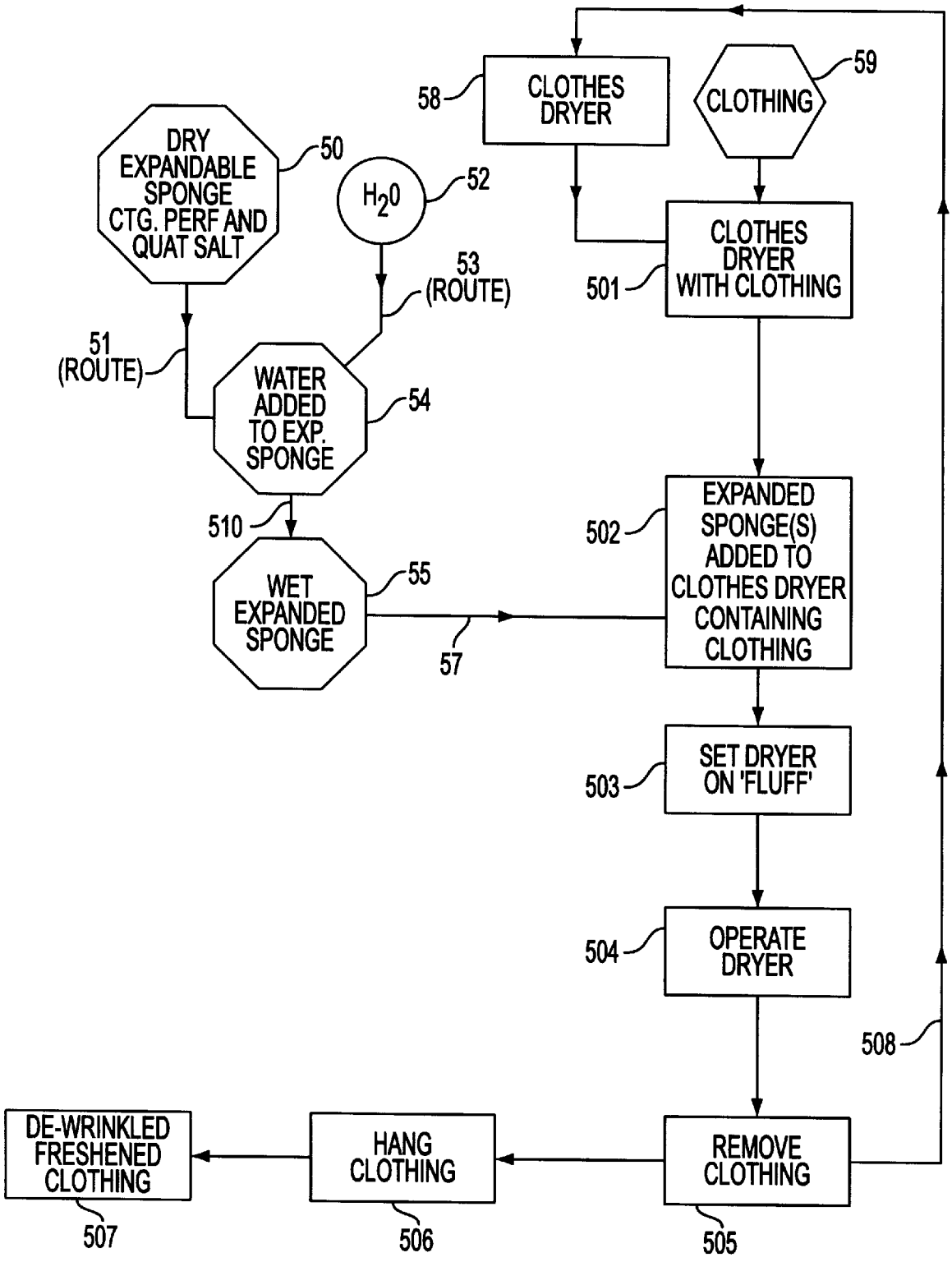
FIG. 5 sets forth the process of our invention for de-wrinkling and freshening and/or aromatizing clothing or linens using the substantially anhydrous, three-dimensional, expandable sponge article of our invention.

Referring to FIG. 5, the anhydrous, three-dimensional, expandable sponge produced according to the processes as described in FIGS. 3 and 4, supra, is conveyed from location 50 via conveyor 51 to location 54 where water from location 52, being passed through line 53, is added thereto. The wet expanded sponge is then conveyed to location 55 via conveyor 510. Clothing (and/or linens) from location 59 is placed into the clothing (and/or linens) dryer (indicated by reference numeral 58) at location 501. The wet expanded sponge from location 55 is conveyed via conveying means 57 into the dryer at process location 502. The dryer is now in a position to be operated with the clothes and/or linens contained therein together with the wet expanded perfume oil-quaternary salt-containing sponge. Thus, the dryer is set on the "fluff" cycle at process location 503 and operated at process location 504.

At the end of the fluff cycle, the dryer operation is terminated. The dryer is opened and clothing and/or linens are removed at process location 505. The resulting clothing may either be recycled via process line 508 back into the clothing dryer if additional freshening and/or aromatization and/or de-wrinkling is required, or the resulting clothing and/or linens may be hung and/or stretched at process location 506. The resulting de-wrinkled, aromatized and/or freshened clothing is indicated at process location 507.

The following example is non-limiting, and our invention is only intended to be restricted according to the claims.

EXAMPLE A

The following anhydrous, hydrophobic fragrance mixture is produced:

| Ingredients | Parts by Weight |
|---|---|
| Bergamot oil, ahydrous | 150 |
| Orange oil, anhydrous | 200 |
| Lemon oil, anhydrous | 50 |

-continued

| Ingredients | Parts by Weight |
|---|---|
| Ylang oil, anhydrous | 2 |
| γ-Methyl ionone | 20 |
| Vetiver Venezuela (anhydrous) | 18 |
| Ethyl-4-(3'-methyl butyl) cyclohexyl ether (anhydrous) | 18 |
| 1,5,9-Trimethyl cyclododecatriene-1,5,9 | 12 |

The resultant perfume formulation is a "woody cologne" formulation.

EXAMPLE I

A cellulosic, hydrophilic, dehydrated, compressed sponge having a diameter of 3.5 inches and a thickness of 0.125 inches and being cylindrical in shape is immersed in a mixture of 20 grams of anhydrous isopropyl alcohol, 5.0 grams of the perfume oil of Example A and 5.0 grams of 100% of VARISOFT® 110 (methyl bis (hydrogenated tallow amidoethyl)2-hydroxyethyl ammonium methyl sulfate), trademark of Sherex Chemical Company, Inc., Box 646, Dublin, Ohio 43017. The unexpanded sponge is allowed to completely absorb the solution to its maximum capacity. The resultant sponge is allowed to air dry.

The resulting air-dried sponge is saturated with 25.5 grams of water. The resulting, wet expanded sponge is placed into a General Electric Automatic Clothes Dryer as described in General Electric Publication No. 49-9210(6-76) published by General Electric Corporation, Home Laundry Products Division, Appliance Park, Louisville, Ky. 40225. Two wrinkled men's suits are placed into the dryer. The dryer is then placed on the "fluff" (no heat) cycle setting. The dryer with the clothes and wet sponge contained within it is operated for a period of 25 minutes on the "fluff" cycle (no heat). At the end of the period, the two suits are removed from the dryer and are placed on hangers. After two hours, the suits have no wrinkles, and have a faint, esthetically pleasing woody cologne, fresh aroma.

What is claimed is:

1. A process for de-wrinkling and freshening and/or aromatizing clothing or linens comprising the steps of:

(i) forming a substantially anhydrous, three-dimensional, expandable sponge article located in a three-dimensional space having a vertical z axis and horizontal x and y axes, consisting essentially of:

(a) a substantially anhydrous, hydrophilic, expandable sponge substance having a volumetric expandability factor of from about 1.3 up to about 4.0, having a discrete geometric shape, a thickness along the z axis in the range of from about 0.05 inches up to about 2.0 inches, an average dimension along the x axis of from about 1 inch up to about 6 inches, an average dimension along the y axis of from about 1 inch up to about 6 inches, a surface area of from about 3 square inches up to about 150 square inches and sufficient porosity to retain from about 0.25 up to about 2.0 grams of perfume oil; and (b) contained within the interstices of said sponge substance and absorbed therein from about 0.25 up to about 2.0 grams of a substantially hydrous perfume oil intimately admixed with from about 0.25 up to about 2.0 grams of at least one substantially anhydrous fragrance substantivity-fabric relaxing agent selected from the group consisting of dialkyl dimethyl quaternary ammonium salts, imidazolinium quaternary salts, diamidoamine quaternary salts and monomethyl trialkyl quaternary ammonium salts;

(ii) adding water to the sponge article in a weight ratio of water:article of from about 1:5 up to about 5:1 in order to form a hydrated article;

(iii) providing an automatic clothes and linen dryer having a "fluff" cycle which operates at from about 20° C. up to about 30° C. at atmospheric pressure;

(iv) placing the clothing and/or linens into said automatic clothes and linen dryer;

(v) placing said hydrated article into said automatic clothes and linen dryer;

(vi) setting the dryer to operate for a designated time period Δθ solely on the "fluff" cycle;

(vii) operating said dryer for the time set for the "fluff" cycle; and (viii) removing the clothing and/or linens from the dryer, wherein the time set for the "fluff" cycle is defined according to the algorithm:

$$-K_3 \ln_e\left[\frac{K_1 W_2 + K_2}{K_1 W_1 + K_2}\right] = \Delta\theta$$

wherein $K_1$, $K_2$ and $K_3$ are constants depending on the sponge surface area, as well as the surface area of the clothes and/or linens to be treated, and the ratio of dry cloth in the clothes and/or linens to clothes and/or linens:void space; $W_2$ is the water remaining in the sponge article and in the clothing and/or linens to be treated after the "fluff" cycle; and $W_1$ is the initial water weight in the sponge article and the clothing and/or linens to be treated.

2. A process for de-wrinkling and freshening and/or aromatizing clothing or linens comprising the steps of:

(i) forming a substantially anhydrous, three-dimensional, expandable sponge article located in a three-dimensional space having a vertical z axis and horizontal x and y axes, consisting essentially of:

(a) a substantially anhydrous, hydrophilic, expandable sponge substance having a volumetric expandability factor of from about 1.3 up to about 4.0, having a discrete geometric shape, a thickness along the z axis in the range of from about 0.05 inches up to about 2.0 inches, an average dimension along the x axis of from about 1 inch up to about 6 inches, an average dimension along the y axis of from about 1 inch up to about 6 inches, a surface area of from about 3 square inches up to about 150 square inches and sufficient porosity to retain from about 0.25 up to about 2.0 grams of perfume oil; and (b) contained within the interstices of said sponge substance and absorbed therein from about 0.25 up to about 2.0 grams of a substantially anhydrous perfume oil intimately admixed with from about 0.25 up to about 2.0 grams of at least one substantially anhydrous fragrance substantivity-fabric relaxing agent selected from the group consisting of dialkyl dimethyl quaternary ammonium salts, imidazolinium quaternary salts, diamidoamine quaternary salts and monomethyl trialkyl quaternary ammonium salts;

(ii) adding water to the sponge article in a weight ratio of water:article of from about 1:5 up to about 5:1 in order to form a hydrated article;

(iii) providing an automatic clothes and linen dryer having a "fluff" cycle which operates at from about 20° C. up to about 30° C. at atmospheric pressure;

(iv) placing the clothing and/or linens into said automatic clothes and linen dryer;

(v) placing said hydrated article into said automatic clothes and linen dryer;

(vi) setting the dryer to operate for a designated time period Δθ solely on the "fluff" cycle;

(vii) operating said dryer for the time set for the "fluff" cycle; and (viii) removing the clothing and/or linens from the dryer, wherein the time set for the "fluff" cycle is defined according to the algorithm:

$$\ln_e\left[\frac{K_1 W_1 + K_2}{K_1 W_2 + K_2}\right] = \frac{\Delta\theta}{K_3}$$

wherein $K_1$, $K_2$ and $K_3$ are constants depending upon the sponge surface area and the surface area of the clothes and/or linens to be treated, and the ratio of dry cloth in the clothes and/or linens to be treated:void space in the clothes and/or linens to be treated and sponge article; and $W_1$ is the initial water weight in the sponge article placed into the dryer and the clothing and/or linens to be treated.

3. A process for de-wrinkling and freshening and/or aromatizing clothing or linens comprising the steps of:

(i) adding water to the sponge article formed using process step (i) of claim 1 in a weight ratio of water:article of from about 1:5 up to about 5:1 in order to form a hydrated article;

(ii) providing an automatic clothes and linen dryer having a "fluff" cycle which operates at from about 20° C. up to about 30° C. at atmospheric pressure;

(iii) placing the clothing and/or linens into said automatic clothes and linen dryer;

(iv) placing said hydrated article into said automatic clothes and linen dryer;

(v) setting the dryer to operate for a designated time period Δθ solely on the "fluff" cycle;

(vi) operating said dryer for the time set for the "fluff" cycle; and (vii) removing the clothing and/or linens from the dryer, wherein the time set for the "fluff" cycle is defined according to the algorithm:

$$-K_3 \ln_e\left[\frac{K_1 W_2 + K_2}{K_1 W_1 + K_2}\right] = \Delta\theta$$

wherein $K_1$, $K_2$ and $K_3$ are constants depending on the sponge surface area, as well as the surface area of the clothes and/or linens to be treated, and the ratio of dry cloth in the clothes and/or linens to clothes and/or linens:void space; $W_2$ is the water remaining in the sponge article and in the clothing and/or linens to be treated after the "fluff" cycle; and $W_1$ is the initial water weight in the sponge article and the clothing and/or linens to be treated.

4. A process for de-wrinkling and freshening and/or aromatizing clothing or linens comprising the steps of:

(i) adding water to the sponge article formed using the process step (i) of claim 1 in a weight ratio of water:article of from about 1:5 up to about 5:1 in order to form a hydrated article;

(ii) providing an automatic clothes and linen dryer having a "fluff" cycle which operates at from about 20° C. up to about 30° C. at atmospheric pressure;

(iii) placing the clothing and/or linens into said automatic clothes and linen dryer;

(iv) placing said hydrated article into said automatic clothes and linen dryer;

(v) setting the dryer to operate for a designated time period Δθ solely on the "fluff" cycle;

(vi) operating said dryer for the time set for the "fluff" cycle; and (vii) removing the clothing and/or linens from the dryer, wherein the time set for the "fluff" cycle is defined according to the algorithm:

$$\ln_e\left[\frac{K_1W_1+K_2}{K_1W_2+K_2}\right]=\frac{\Delta\theta}{K_3}$$

wherein $K_1$, $K_2$ and $K_3$ are constants depending upon the sponge surface area and the surface area of the clothes and/or linens to be treated, and the ratio of dry cloth in the clothes and/or linens to be treated:void space in the clothes and/or linens to be treated and sponge article; and $W_1$ is the initial water weight in the sponge article placed into the dryer and the clothing and/or linens to be treated.

5. The process of claim 4 wherein the weight loss of water from the hydrated sponge article is defined by the algothrim:

$$\Delta W=\left[\frac{K_2}{K_1}\right]e^{\left(\frac{\Delta\theta}{K_3}\right)}$$

wherein $K_1$, $K_2$ and $K_3$ are constants depending on the sponge surface area, the surface area of the clothes and/or linens to be treated and the ratio of surface area of clothes and/or linens to be treated:void space of the clothes and/or linens to be treated and void space of sponge article; and the symbol, ΔW, is the weight loss of the water from the hydrated sponge article, and wherein:

$$2\le\frac{K_2}{K_1}\le 5$$

and $$4\leqq K_3\leqq 6$$

when Δθ is measured in minutes and the term ΔW is measured in grams.

* * * * *